United States Patent [19]

Myers

[11] Patent Number: 4,488,624

[45] Date of Patent: Dec. 18, 1984

[54] DUFFLE BAG SECURITY

[76] Inventor: Jay E. Myers, 353 Cedar Way, Apt. A, Laguna Beach, Calif. 92651

[21] Appl. No.: 506,048

[22] Filed: Jun. 20, 1983

[51] Int. Cl.[3] ..... A45C 3/00

[52] U.S. Cl. ..... 190/120; 70/49

[58] Field of Search ..... 190/120, 121, 101, 102; 150/47, 23; 70/67, 68, 76, 49

[56] References Cited

U.S. PATENT DOCUMENTS

| | | | |
|---|---|---|---|
| 214,771 | 4/1879 | Gathright et al. . | |
| 570,899 | 11/1896 | Boynton | 150/23 |
| 596,168 | 12/1897 | Kneeland . | |
| 1,513,176 | 10/1924 | Lyde . | |
| 1,841,154 | 1/1932 | Rath . | |
| 2,114,683 | 4/1938 | Kates | 190/119 |
| 2,339,968 | 1/1944 | Wein . | |
| 3,435,642 | 4/1969 | DelPesco | 70/49 |
| 4,075,878 | 2/1978 | Best | 70/49 |

*Primary Examiner*—Steven M. Pollard

*Attorney, Agent, or Firm*—Gausewitz, Carr, Rothenberg & Edwards

[57] ABSTRACT

A duffle bag having a number of latching devices and slide fastener closures for providing access to a number of different interior compartments is provided with a single security device that prevents inadvertent or unauthorized opening of the latching devices and fasteners. The slide fasteners have apertured slide operators. A bag flap is closed by quarter turn twist locks having apertured twist studs. A flexible cable, fixed to the bag at one end, is threaded through the slide operators and apertured twist studs and has its other end connected to a lock plate that is fixed to the bag. The lock plate is arranged to accept a key-operated lock that prevents unauthorized detachment of the cable end from the lock plate.

13 Claims, 5 Drawing Figures

DUFFLE BAG SECURITY

BACKGROUND OF THE INVENTION

The present invention relates to luggage security, and more particularly concerns an arrangement for preventing inadvertent or unauthorized opening of luggage latching devices.

Soft-sided luggage, and in particular luggage of the type generally termed a duffle bag, requires a number of latches or slide fasteners for effectively closing the bag interior compartments. For example, a large flexible flap, to cover a duffle bag opening, may have a separate and independent slide fastener to close the flap along each of its sides and may have one or more latching type fasteners, such as quarter turn twist lock fasteners, for securing the forward edge of the flap to the bag body. A single slide fastener, running continuously around all three sides of such a flap may be feasible only where the slide fastener runs in a plane that is substantially perpendicular to the plane of the flap. However, such a single continuous fastener is not feasible where the fastener must lie in the plane of the flap and turn a corner in such a plane. Accordingly, separate latching devices, whether slide fasteners, twist lock fasteners, or other commonly known luggage fasteners, must be used for the three different edges of the flap.

Duffle-type luggage often is formed with a number of interior compartments, each having its own closure and latching device. Thus, it is common to have a duffle-type bag with four or more slide fasteners, in addition to other fasteners as may be appropriate. Slide fasteners may become inadvertently displaced and accidently opened during luggage handling. For this reason, and also to prevent unauthorized opening of the slide fastener, it is common to attach a D-ring to the luggage adjacent the slide fastener operation tongue in closed position, and lock the slide to the D-ring through the slide tongue. Similarly, for other types of luggage fasteners, such as the common hinged-over-the-center hard luggage latch, various types of locks, such as key operated locks, are connected to or built into the latch to prevent inadvertent and unauthorized operation. However, where a number of such latches are required for a given piece of luggage, a number of locking devices are required. Prior practice requires a separate lock for each luggage latching device. A large number of locks greatly adds to the cost of the luggage and to the inconvenience to the user because of the time and effort involved in locking and unlocking a number of such devices.

Accordingly, it is an object of the present invention to avoid or minimize above mentioned problems.

SUMMARY OF THE INVENTION

In carrying out principals of the present invention in accordance with a preferred embodiment thereof, security is provided for a plurality of latching devices of an article of luggage by means of a flexible cable that is secured to latch members of each of the latching devices to restrain unlatching of the devices, and locking means are provided for locking the cable to the bag body and to the latch members. In a specific embodiment, a single cable is fixed at one end of the bag body and threaded through operating tongues of the several slide fasteners and through the apertured twist studs of twist lock fasteners, and has its other end connected to a locking bracket to which it may be securely connected by means of a key-operated lock.

DETAILED DESCRIPTION

Figure 1:
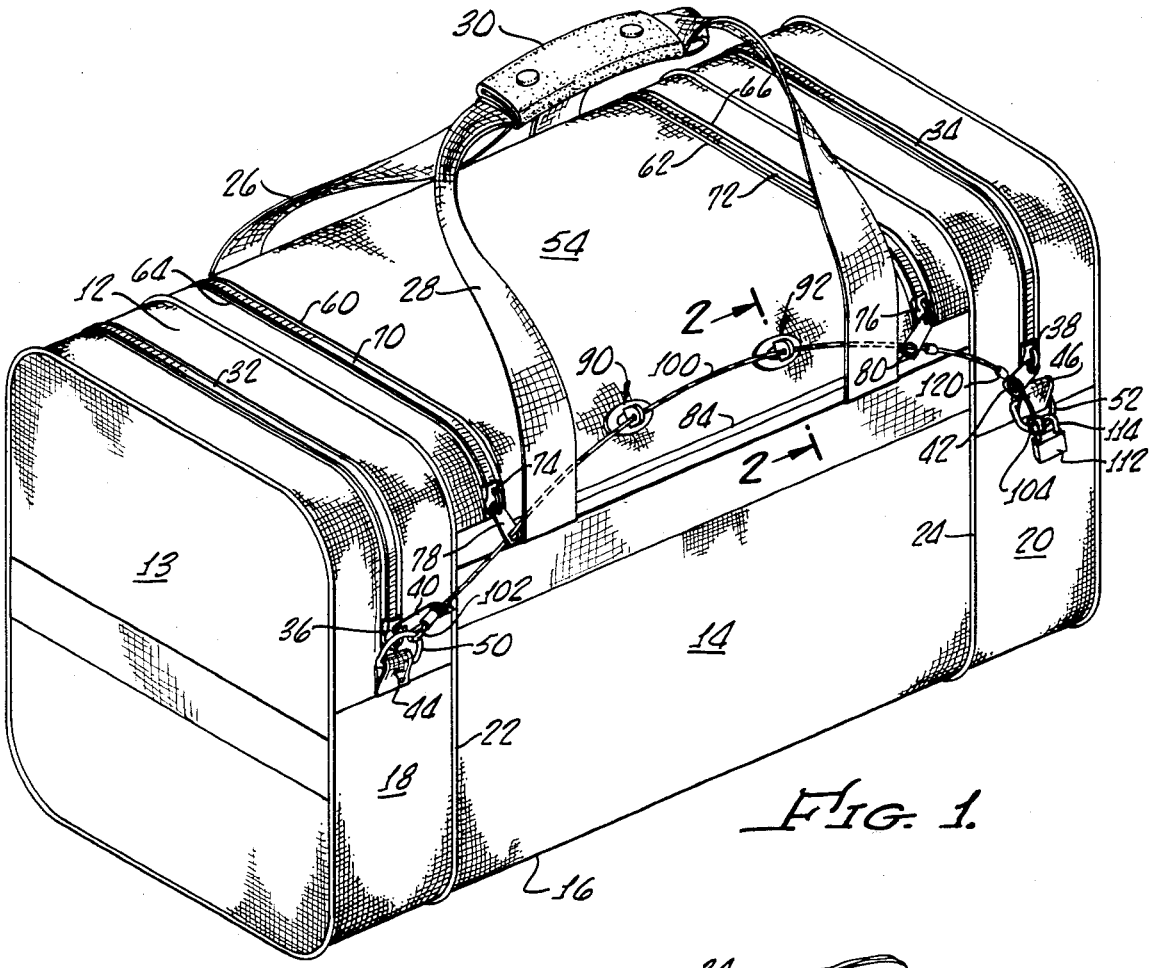
FIG. 1 is a pictorial view of a multi-latch article of luggage having a security cable embodying principals of the present invention.
Figure 4:
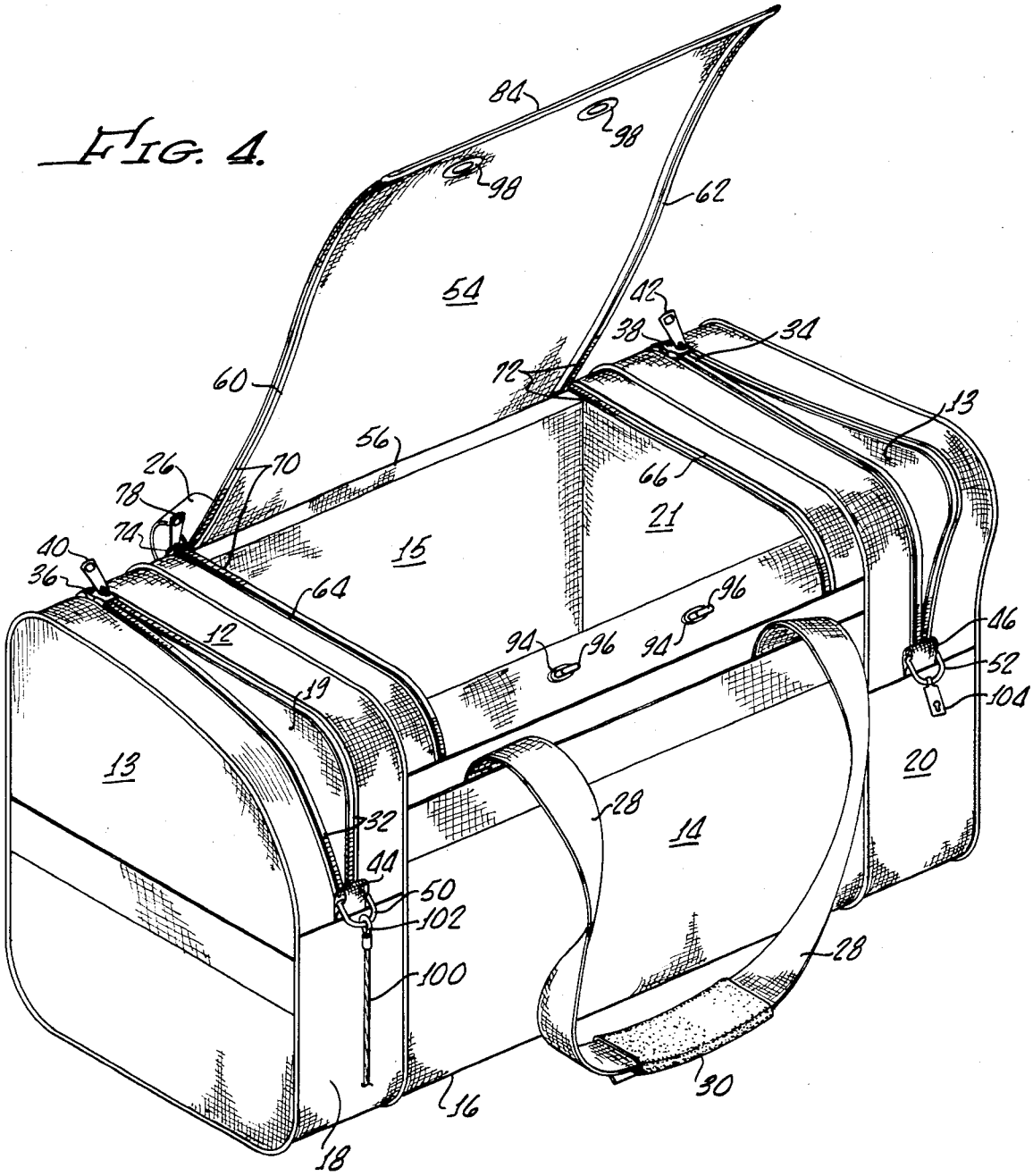
FIG. 4 shows the luggage with its compartments open.

As illustrated in FIGS. 1 and 4, a duffle bag, which is merely illustrative of one of a large number of similar types of multi-compartment soft luggage, is formed of a number of sections of woven material, such as a heavy canvas, sewn together to define a substantially rectangular box shaped container having a top 12, ends 13, a front 14, a back 15, and bottom 16. The luggage is formed with opposite end compartments 18 and 20 which are separated from the main intermediate compartment by means of flexible sheet material partitions 19, 21 that terminate at the exterior of the bag in beading 22, 24. Flexible handles 26, 28 are secured to the back and front portions of the bag, and connected together for carrying of the bag by means of a detachable folded handle 30.

Each of the end compartments 18 and 20 is accessible through an opening provided by a closure in the form of a conventional slide fastener 32 and 34, respectively. Each slide fastener includes a slide 36, 38 and an apertured slide operating tongue 40, 42 pivotally connected to the slide. A flexible loop as of canvas or similar material 44, 46, is sewn to the bag body closely adjacent the slides 36, 38 when in closed position. D-rings 50 and 52 are captured in the loops 44, 46 so that, according to the prior art, a key-operated lock may have its hasp or shank inserted through the D-ring and through the slide tongue to lock the slide fastener in closed position.

The illustrative bag of FIG. 1 has a main intermediate compartment closed by a flap 54 which is permanently sewn along its back edge 56 to the back side of the bag, and has free side edges 60, 62 which are connected to the adjoining edges of the bag top edges 64, 66 by means of additional separate and independent slide fasteners 70, 72, each having a slide 74, 76 and a slide operating tongue 78, 80 pivotally connected thereto.

Figure 2:
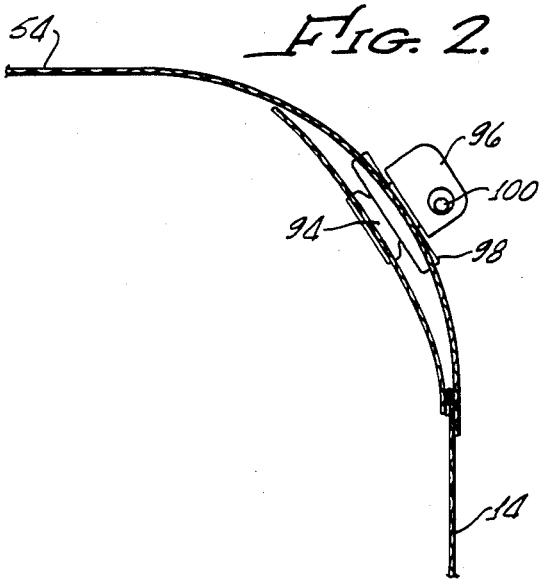
FIG. 2 is a section taken on lines 2—2 of FIG. 1, showing the operation with respect to a twist lock fastener.

Because of the extent of the front edge 84 of flexible flap 54, additional fastening devices are provided to keep the front edge of the flap in closed position. Such additional fasteners are illustrated in the drawings as a pair of quarter turn twist lock fasteners 90, 92, each having a stud base 94 fixed to the bag front 16 and each carrying a pivoted twist stud 96 that is adapted to extend through a grommet 98 fixed to the flap adjacent its front edge. The grommet has an elongated aperture that conforms to the elongated shape of a fixed portion of the stud projecting from the stud base, and also conforming to the elongated shape of the twist stud 96. The latter can be pivoted about the stud axis through 90 degrees from an open position (FIG. 4) in which the stud is aligned with, and passes freely through, the grommet to a closed position (FIGS. 1, 2) wherein the twist stud cannot be withdrawn. The twist studs are apertured for security purposes as part of the present invention.

In the exemplary duffle bag illustrated in the drawings, six separate latching devices are employed, four slides and two twist fasteners. According to prior practice, six separate locks would be required to completely lock the bag. The cost, time, trouble and weight of six separate locks may often cause the bag user to forego the use of any one or more locks. However, the present invention enables the locking of all six latching devices with but a single lock.

Figure 3:
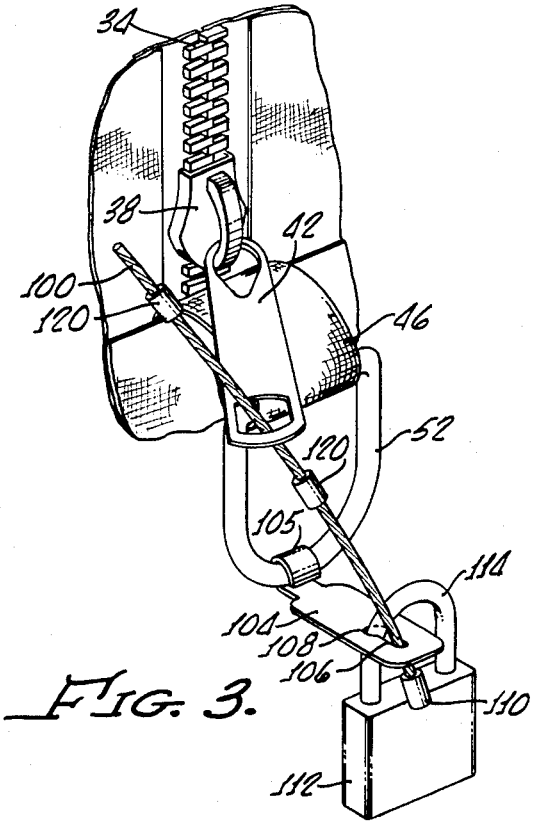
FIG. 3 is an enlarged pictorial view showing details of the cable end locking bracket.

A flexible cable 100 of steel or of other material having a suitable strength and resistance to tampering has its end formed with a loop 102 through which passes the D-ring 50 so that the cable end is permanently and securely connected to the bag body. The cable is threaded through the apertures of each of the slide operator tongues of the four slide fasteners, and is also threaded through the apertures of the twist studs 96 of the twist lock fasteners. The free end of the cable is detachably connected and locked to a locking bracket or plate 104 (see FIG. 3), having an end 105 that is bent around the D-ring 52 that is connected to the bag body at the other end of the bag. The locking plate 104 is formed with a keyhole-shaped slot or opening having a relatively narrow portion 106 and a relatively wide portion 108. As illustrated in FIG. 3, narrow portion 106 has a diameter slightly greater than the diameter of the cable 100 so that the latter can freely pass through the narrow portion 106. To the end of the cable is fixed an enlargement sleeve 110 which has a diameter just less than the diameter of the wider portion 108 of the keyhole slot. Thus, the cable and its enlargement 110 can freely pass through the relatively wide opening portion 108, but the cable enlargement will not pass through the narrow portion 106. A kock 112 has a U-shaped shank 114 with a diameter that is slightly less than the diameter of the wide portion 108.

To lock the cable end to the lock plate 104, the cable enlargement 110 is inserted through the wide portion 108 of the keyhole slot, and the cable is transversely moved into the narrow portion 106. Then the lock shank is inserted through the wide portion 108 and the shank locked to the body of the lock. With the slot portion 108 substantially filled by the lock shank, the cable 106 cannot move from the narrow slot portion into the wide slot portion where it must be positioned if the cable and the enlargement are to be withdrawn from the lock plate 104.

In order to provide the cable with an adjustable effective length in its locked position, at least one additional enlargement 120 is fixed to the cable at a point spaced from the cable end that bears the fixed enlargement 110. Two or more mutually spaced additional enlargements may be provided, if desired. The effective cable length in locked condition thus may be shortened by pulling the cable further through the lock plate until the enlargement 120 passes through the plate, then locking the cable to the plate with the enlargement 120 captured on the side of the locking plate opposite the fastening devices.

With the cable in place and threaded through the apertures in each of the latching members of the latching devices, none of the latching devices can be unlatched. Although the twist studs of the twist lock fasteners may be rotated a small amount because of the flexibility of the cable, the twist studs cannot be rotated enough to allow them to be withdrawn from the grommet apertures. The slide fastener slides may be movable for a very short distance from the extreme closed position because of the flexibility of the cable and because of the flexibility of the bag itself. Nevertheless, the cable will effectively restrain any but a small amount of motion of the slide fastener slides. Thus, the cable will prevent inadvertent unlatching of any of the latching devices and inadvertent opening of any of the slide fasteners. It will also prevent unauthorized forcible opening of the latching devices to any significant degree and, thus, will prevent forced entry into all of the interior compartments through any of the existing bag closures.

Figure 5:
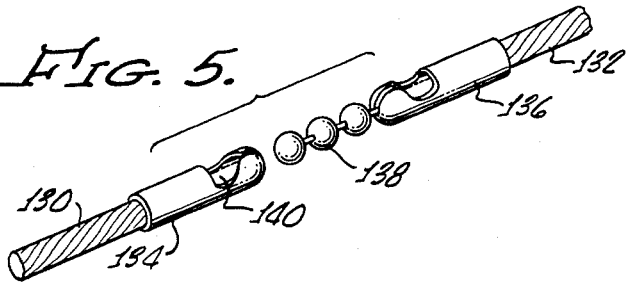
FIG. 5 is a fragmentary view of sections of a two piece cable having detachably connected ends.

Illustrated in FIG. 5 is an alternate arrangement of the security cable which provides for inadvertant operation and opening of any of the latching devices, but does not specifically involve the use of a key operated lock that might otherwise prevent or resist forcible opening. In the arrangement illustrated in FIG. 5, the cable is made in first and second sections 130, 132, each of which has an end (not shown in FIG. 5) which is fixedly and permanently secured to one of the D-rings 50, 52 at opposite ends of the bag. Each of the cable sections has a free end to which is fixedly secured a snap or friction-type connector having a first part 134 on the end of cable 130 and a second part 136 on the end of cable 132. The connector may be any one of a number of common types and is illustrated as comprising a chain of small spheres 138, each of which is adapted to be frictionally inserted and retained within a cavity 140 of connector part 134. If deemed necessary or desirable, a protective sleeve (not shown) may be applied over the connector parts 134, 136 when interconnected.

The arrangement illustrated in FIG. 5 will prevent inadvertent opening of any of the latching devices, but needs no key or special tool to detach the cable section connectors. Upon detachment of the cable section connectors, each of the cables 130 and 132 may be withdrawn from their threaded engagement through the fastener or latching member apertures to allow these to be freely operable.

Many different kinds of fastening devices are known and have been commonly employed for different types of luggage, including both soft-sided luggage and hard-sided or molded luggage. Where such luggage employs a number of spaced latches, each such latch may be suitably apertured, or an apertured member, such as a ring, may be fixed to such latch so that a single flexible cable may be threaded therethrough and locked to the bar, as shown and described in connection with the illustrated duffle bag.

A significant feature of the present invention is its ready applicability to existing luggage with little or no modification of the luggage required. Where a plurality of slide fasteners is employed, luggage is often made with several D-rings of the type illustrated at 50 and 52 in FIG. 1. Thus, a cable embodying principals of the present invention may be readily connected to one of such D-rings, and a locking plate to another, so that the cable may be threaded through the slide fastener operator tongue apertures and also through any intermediate D-rings adjacent such intermediate slide fastener operators that may be attached to the luggage body. The presence of such intermediate D-rings fixed to the bag body enhances the security of the described locking cable because the threading of the cable through such intermediate D-rings will further restrain the displacement of intermediate sections of the cable relative to the bag.

In the arrangement of the bag illustrated in FIG. 1, the presence of the twist lock fasteners intermediate the cable ends helps to restrain motion of the cable. For example, with the cable in its locked position, one may attempt to open slide fastener 70, and its slide 74 may be moved rearwardly by a short distance, moving a portion of the cable with it. Because the cable is restrained by the intermediate portion of the bag, by being threaded through the twist lock fasteners, the amount of motion available to the slide 74 is considerably decreased. Thus, if deemed necessary or desirable, a D-ring could be fixed to the bag body adjacent each of the slide operator tongues 78,80. The cable would be threaded through each such D-ring, in addition to being threaded through the aperture of the slide tongue and, thus, it will enhance the securement of the various closures achieved by the cable. Accordingly, it will be seen that each latching member through which the cable is threaded helps to maintain the cable in position and, thus, each fastener helps to hold the other fasteners in latched condition and all collectively act to position the cable. The use of one or more additional enlargements, such as enlargement 120 spaced along the length of the cable inwardly of the enlargement 110 at the cable end, enables the cable to be effectively shortened and pulled more tightly in its locked condition to thereby maximize the restraint imposed by the cable upon the unlatching operation of the latching devices.

Locking plate 104, together with its keyhole-shaped aperture, is at present a preferred arrangement for securely connecting the cable end to the bag so as to restrain inadvertent and unauthorized attachment. It will be readily understood that many other types of cable end locking arrangements are known and may be employed without departing from principals of the present invention. The cable may be locked to the bag by means of a locking plate 104 at both ends, and a lock 112 at both ends, if deemed necessary or desirable. Further, a multisectioned cable, such as illustrated in FIG. 5, may be modified so that the ends are not only detachably connected together, but are held together by means of a key-operated lock, or equivalent device, so as to restrain unauthorized disconnection of the adjoining cable ends.

It will be understood that the arrangement and number of compartments, and the number, arrangement and type of latching devices employed in the bag illustrated in FIGS. 1 and 4, are merely exemplary of many different arrangements, numbers of compartments, and latching devices that may be employed in the practice of the present invention.

The foregoing detailed description is to be clearly understood as given by way of illustration and example only, the spirit and scope of this invention being limited solely by the appended claims.

I claim:

1. An article of luggage comprising a bag body, closure means movably connected to the bag body for selectively blocking and permitting access to the bag interior, a plurality of latching devices for holding said closure means in closed position wherein access to the bag interior is blocked, each said device including a latch member mounted for motion relative to the bag body, a flexible cable engaged with the latch members of at least a group of said latching devices to restrain motion of said latch members, one end of the cable being permanently secured to said bag body, and locking means for locking the cable to said bag body and latch members, said locking means comprising a lock bracket secured to the bag body, and means for detachably locking the other end of the cable to said lock bracket.

2. The luggage of claim 1 wherein said closure means comprises first and second slide fasteners, wherein said latching devices comprise fastener slides, and wherein said latch members comprise slide apertured operating tongues connected to the slides, said slides being mutually spaced from one another when said slide fasteners are closed to block access to the bag interior, said cable slidably and removably extending through said tongue apertures.

3. The luggage of claim 1 wherein said closure means comprises a flap, wherein said latching devices comprise mutually spaced twist fasteners, each having a stud base and a grommet, and wherein said latch members comprise a twist stud pivotally mounted on each stud base, each said twist stud having a hole therethrough, said cable slidably and removably extending through said twist stud holes.

4. An article of luggage comprising a bag body, closure means movably connected to the bag body for selectively blocking and permitting access to the bag interior, a plurality of latching devices for holding said closure means in closed position wherein access to the bag interior is blocked, each said device including a latch member mounted for motion relative to the bag body, a flexible cable engaged with the latch members of at least a group of said latching devices to restrain motion of said latch members, and locking means for locking the cable to said bag body and latch members, said closure means comprising a flap, said latching devices comprising mutually spaced twist fasteners, each having a stud base and a grommet, said latch members comprising a twist stud pivotally mounted on each stud base, each said twist stud having a hole therethrough, said cable slidably and removably extending through said twist stud holes, said locking means comprising a lock bracket fixedly connected to said bag body and having a keyhole-shaped slot, said slot having a relatively narrow portion adapted to receive said cable, and having a relatively wide portion adapted to receive the shank of a lock, said shank having a diameter greater than the diameter of the cable, and an enlarging sleeve fixed to said cable, said sleeve having a size to allow its passage through said wide slot portion, but not through said narrow slot portion.

5. An article of luggage comprising a bag body, closure means movably connected to the bag body for selectively blocking and permitting access to the bag interior, a plurality of latching devices for holding said closure means in closed position wherein access to the bag interior is blocked, each said device including a latch member mounted for motion relative to the bag body, a flexible cable engaged with the latch members of at least a group of said latching devices to restrain motion of said latch members, and locking means for locking the cable to said bag body and latch members, said locking means comprising a lock bracket fixedly connected to said bag body and having a keyhole-shaped slot, said slot having a relatively narrow portion adapted to receive said cable, and having a relatively wide portion adapted to receive the shank of a lock, said shank having a diameter greater than the diameter of the cable, and an enlargement sleeve fixed to said cable, said sleeve having a size to allow its passage through said wide slot portion, but not through said narrow slot portion.

6. An article of luggage comprising a bag body, closure means movably connected to the bag body for selectively blocking and permitting access to the bag interior, a plurality of latching devices for holding said closure means in closed position wherein access to the bag interior is blocked, each said device including a latch member mounted for motion relative to the bag body, a flexible cable engaged with the latch members of at least a group of said latching devices to restrain motion of said latch members, and locking means for locking the cable to said bag body and latch members, said closure means comprising first and second slide fasteners, said latching devices comprising fastener slides, said latch members comprising slide apertured operating tongues connected to the slides, said slides being mutually spaced from one another when said slide fasteners are closed to block access to the bag interior, said cable slidably and removably extending through said tongue apertures, said locking means comprising a lock bracket fixedly connected to said bag body and having a keyhole-shaped slot, said slot having a relatively narrow portion adapted to receive said cable, and having a relatively wide portion adapted to receive the shank of a lock, said shank having a diameter greater than the diameter of the cable, and an enlarging sleeve fixed to said cable, said sleeve having a size to allow its passage through said wide slot portion, but not through said narrow slot portion.

7. A duffle bag comprising a flexible bag body having a plurality of interior compartments, a plurality of spaced slide fasteners for selectively providing and blocking access to one or more of said interior compartments, each said fastener having an apertured slide operating tongue, and means for locking all of said fasteners with a single lock, said means for locking comprising a flexible cable extending through said apertured tongues, said cable having one end permanently secured to said bag body, and means for locking the cable to the bag and for preventing withdrawal of the cable from said apertured tongues, said locking means comprising means for detachably locking the other end of the cable to the bag, and means for restraining motion of an intermediate portion of the cable relative to the bag.

8. The bag of claim 3 including a closure flap between said slide fasteners, a flap fastener detachably connected to said flap, said cable intermediate portion extending through said flap fastener to provide said means for restraining the cable intermediate portion.

9. A duffle bag comprising a flexible bag body having a plurality of interior compartments, a plurality of spaced slide fasteners for selectively providing and blocking access to one or more of said interior compartments, each said fastener having an apertured slide operating tongue, and means for locking all of said fasteners with a single lock, said means for locking comprising a flexible cable extending through said apertured tongues, and means for locking the cable to the bag and for preventing withdrawal of the cable from said apertured tongues, said means for locking the cable comprising a lock bracket fixedly connected to said bag body and having a keyhole-shaped slot, said slot having a relatively narrow portion adpated to receive said cable, and having a relatively wide portion adapted to receive the shank of a lock, said shank having a diameter greater than the diameter of the cable, and an enlarging sleeve fixed to said cable, said sleeve having a size to allow its passage through said wide slot portion, but not through said narrow slot portion.

10. For use with a duffle bag having a plurality of spaced interior compartments, a plurality of fasteners for closing said compartments, and a ring fixed to the bag adjacent an end of each slide fastener, whereby each fastener can be locked to its associated ring by a lock extending through the ring and through an aperture in the slide operating tongue of the slide fastener, an improved security device for locking all of the slide fasteners with a single lock comprising a flexible cable extending through the apertures of said slide operating tongues, means for connecting one part of the cable to one of said rings, and means for detachably locking another part of the cable to another of said rings, said means for detachably locking comprising a locking plate secured to said last mentioned ring, said plate having a keyhole-shaped slot with narrow and wide portions, an enlargement fixed to the cable whereby the cable, but not the enlargement, can pass through the narrow portion, and whereby a lock shank can be inserted through the wide portion to retain the cable in the narrow slot portion, said enlargement having a size to pass through said wide slot portion when said lock shank is removed and said cable is shifted to said wide portion.

11. For use with a duffle bag having a plurality of spaced interior compartments, a plurality of fasteners for closing said compartments, and a ring fixed to the bag adjacent an end of each slide fastener, whereby each fastener can be locked to its associated ring by a lock extending through the ring and through an aperture in the slide operating tongue of the slide fastener, an improved security device for locking all of the slide fasteners with a single lock comprising a flexible cable extending through the apertures of said slide operating tongues, means for permanently connecting one part of the cable to one of said rings, and means for detachably locking another part of the cable to another of said rings.

12. The apparatus of claim 11 wherein said duffle bag includes a closure flap having a twist fastener that includes a pivotally mounted latching stud, and wherein said improved security device includes an aperture extending through said latching stud, said cable extending through the aperture of said stud when the cable is locked to said other ring.

13. A duffle bag comprising a bag body divided into at least first and second end compartments adjacent opposite ends of the bag body and a main compartment intermediate said end compartments, first and second slide fasteners for closing said end compartments, a closure flap for closing said intermediate compartment, said flap being connected to the bag body at a rear portion of the flap, and having free forward edge and side edges, third and fourth slide fasteners for connecting the flap side edges to the bag body, a flap fastener connected to the bag body for holding the forward edge of the flap adjacent the bag body, each said slide fastener having an apertured slide operator tongue, and said flap fastener having an aperture therethrough, a flexible cable extending through said apertured slide operators and through said apertured flap fastener, and means for locking the cable to the bag body and to the slide operator tongues and flap fastener, said means for locking the cable comprising a locking plate secured to the bag body adjacent one of said fasteners, said locking plate having a keyhole-shaped slot with narrow and wide portions, an enlargement fixed to the cable, whereby the cable, but not the enlargement, can pass through the narrow portion of the locking plate, said cable enlargement having a size to pass through the wide slot portion, but not the narrow slot portion, said cable passing through said narrow slot portion when the bag is locked, and locking means for retaining the cable in said narrow slot portion, whereby said cable enlargement cannot be withdrawn from said locking plate.

* * * * *

UNITED STATES PATENT AND TRADEMARK OFFICE

CERTIFICATE OF CORRECTION

PATENT NO. : 4,488,624

DATED : Dec. 18, 1984

INVENTOR(S) : JAY E. MYERS

It is certified that error appears in the above-identified patent and that said Letters Patent is hereby corrected as shown below:

In claim 8 (column 8), line 1, "3" should be -- 7 --.

Signed and Sealed this

*Twenty-eighth* Day of *May 1985*

[SEAL]

*Attest:*

DONALD J. QUIGG

*Attesting Officer* *Acting Commissioner of Patents and Trademarks*